US007003898B2

(12) United States Patent
Aaron

(10) Patent No.: US 7,003,898 B2
(45) Date of Patent: Feb. 28, 2006

(54) LUMBER STICKER

(76) Inventor: James F. Aaron, 2035 Keely Rd., Franklin, PA (US) 16323

( * ) Notice: Subject to any disclaimer, the term of this patent is extended or adjusted under 35 U.S.C. 154(b) by 0 days.

(21) Appl. No.: 10/368,103

(22) Filed: Feb. 18, 2003

(65) Prior Publication Data

US 2003/0154622 A1 Aug. 21, 2003

Related U.S. Application Data

(60) Provisional application No. 60/358,210, filed on Feb. 19, 2002.

(51) Int. Cl.
*F26B 3/00* (2006.01)

(52) U.S. Cl. ..... 34/518; 34/239

(58) Field of Classification Search ..... 34/306, 34/94, 77, 92, 396, 518; 108/51.1, 53.1, 108/91, 93, 55.3
See application file for complete search history.

(56) References Cited

U.S. PATENT DOCUMENTS

| | | | | |
|---|---|---|---|---|
| 851,789 A | | 4/1907 | Alexander | |
| 1,280,046 A | | 9/1918 | Kuhne | |
| 2,679,111 A | | 5/1954 | Leischner | 34/6 |
| 3,757,428 A | | 9/1973 | Runciman | 34/9.5 |
| 3,907,130 A | | 9/1975 | Hutcheson | 214/10.5 R |
| 4,293,605 A | * | 10/1981 | Persson et al. | 428/126 |
| 4,391,202 A | * | 7/1983 | Carter et al. | 108/51.3 |
| 4,506,796 A | * | 3/1985 | Thompson | 211/59.4 |
| 4,788,777 A | | 12/1988 | Davis | 34/239 |
| 5,636,577 A | * | 6/1997 | Gow | 108/57.17 |
| 5,722,626 A | * | 3/1998 | Menchetti et al. | 248/346.01 |
| 5,813,137 A | | 9/1998 | Townsend | 34/518 |
| 6,134,803 A | | 10/2000 | Gilchrist et al. | 34/94 |
| 6,345,652 B1 | | 2/2002 | Townsend | 144/371 |

FOREIGN PATENT DOCUMENTS

| | | |
|---|---|---|
| AT | 407 242 B | 1/2001 |
| CA | 2307464 | 10/2000 |
| DE | 28 32 394 A | 2/1979 |
| DE | 299 02 104 U1 | 6/1999 |
| EP | 0 953 520 A1 | 11/1999 |

* cited by examiner

*Primary Examiner*—Henry Bennett
*Assistant Examiner*—Camtu Nguyen
(74) *Attorney, Agent, or Firm*—The Bilicki Law Firm, P.C.

(57) ABSTRACT

A lumber sticker for separating lumber, comprised of an elongated generally rectangular shaped block with sides shaped such that the lumber sticker will not come to rest on the sides. The lumber sticker has channels cut into the top and bottom surfaces, traversing the width at substantially a diagonal. The channels are cut in an arcuate concave shape or a V-shape, and in one embodiment, the channels are cut at 45 degree angles relative to the lengths of the surfaces such that the channels of the top surface are perpendicular to the channels of the bottom surface. In yet another embodiment, the deepest point of each channel is at the midpoint of each channel. The point of contact between the lumber sticker and the lumber is a substantially flat plateau between each channel.

26 Claims, 2 Drawing Sheets

LUMBER STICKER

CROSS-REFERENCES

This application claims priority to provisional patent application No. 60,358,210 filed on Feb. 19, 2002.

FIELD OF INVENTION

The present invention relates to a separator or sticker for the storage and/or drying of lumber. In particular, the invention describes a separator that permits uniform drying while minimizing the marks that can be left on the wood resulting from stickers.

DETAILED DESCRIPTION OF THE INVENTION

Figure 1:
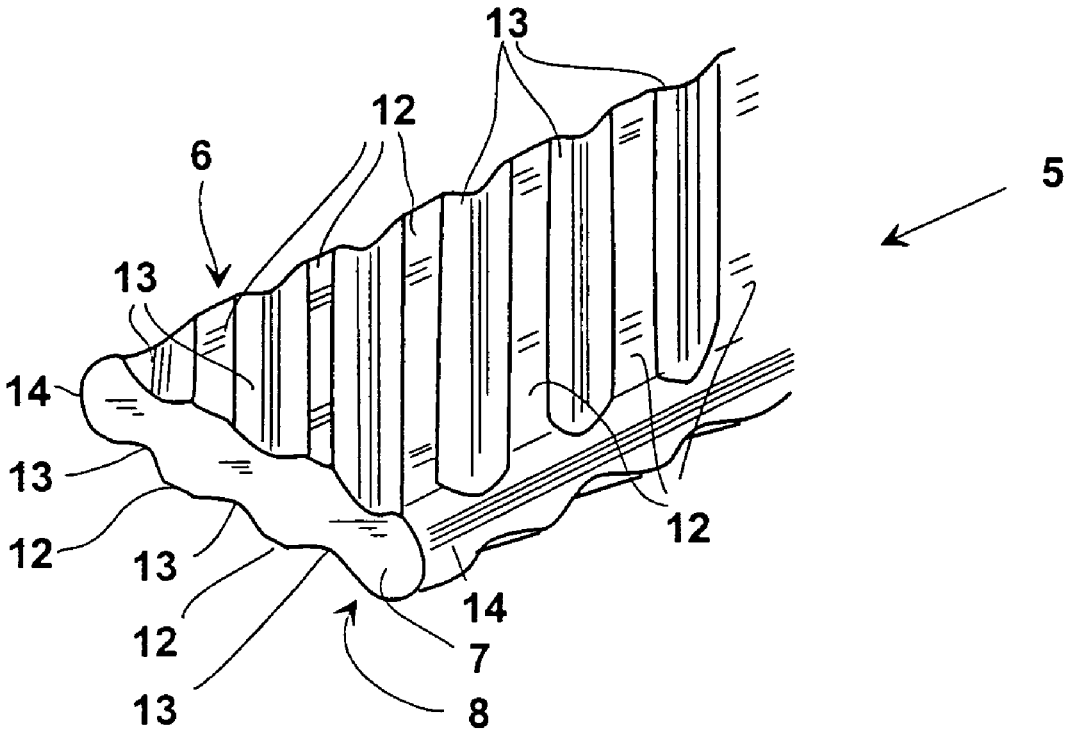
FIG. 1 shows a top view perspective drawing of one embodiment of the invention with rounded channels and rounded side surfaces.

For the purpose of promoting an understanding of the present invention, reference will be made to multiple embodiments of the invention, as illustrated in the drawings. With particular reference to the drawings, the reader should understand that like numerals in different figures refer to the same elements of the invention. Furthermore, although several embodiments are described herein, it will be apparent to one of ordinary skill in the art that modifications and variations may be made without departing from what is regarded as the subject matter of the invention.

The present invention is a wood or lumber separator, commonly referred to as a "lath," "stick," "crosser," or "sticker" (hereinafter, "lumber sticker") used to separate pieces of lumber in a stack or bundle and allow air to flow between layers of lumber and moisture to escape from the wood. The present invention is an elongated block-shaped device comprised of two substantially parallel planar surfaces connected by at least two additional surfaces. The lumber sticker has multiple channels formed or cut into each of the two planar surfaces which allows air to circulate along the channels and around the stacked lumber. Each channel is separated from another channel by a plateau. Note, the channels could include one continuous channel formed into each substantially planar surface, or one helical channel, so long as adjacent parts of the channel are separated by the plateaus.

The lumber sticker may be made of any type of material able to resist the compressive pressure associated with lumber stacking, and in the event that a kiln is used, able to withstand the heat of the kiln. It should be appreciated by one of ordinary skill in the art that any durable, heat resistant, and non-corrosive material can be used such as plastic (e.g., polyethylene, polyurethane, or polystyrene), wood, fiberglass, resin compounds (such as polycarbonate), metals, composites, or other materials commonly used in the art could be used.

FIG. 1 shows a top view perspective drawing of one embodiment of the present invention. In this embodiment, lumber sticker 5 includes substantially planar first surface 6, substantially planar second surface 8, two rounded side surfaces 14, a front surface 7, and a back surface (not shown). Lumber sticker 5 is an elongated and substantially 6-sided, block-shaped sticker in which first surface 6 and second surface 8 are substantially parallel to one another. First surface 6 and second surface 8 are defined as the surfaces upon which lumber may be piled in such a manner as to create a stable stack. The width of lumber sticker 5 is defined as the shortest horizontal measurement taken at right angles between side surfaces 14. Furthermore, the height is the vertical distance between first surface 6 and second surface 8. In one embodiment, the width of lumber sticker 5 is longer than the height. In another embodiment, the width of lumber sticker 5 is approximately twice as long as its height.

Lumber sticker 5 has a plurality of channels 13 on first surface 6 and an additional plurality of channels 13 on second surface 8 which run from one edge of first surface 6 or second surface 8 to a second edge of first surface 6 or second surface 8, respectively. An edge is defined as where one surface meets another surface, whether the surface is first surface 6, second surface 8, side surfaces 14, front surface 7, or back surface. In one embodiment, channels 13 traverse the widths of first surface 6 and second surface 8. Alternately, channels 13 transverse lumber sticker 5 lengthwise. In another embodiment, channels 13 traverse the width of first surface 6 and second surface 8 at a diagonal. In the embodiment shown, channels 13 are cut at approximately a forty five degree (45°) angle relative to the length of lumber sticker 5. In another embodiment, channels 13 traverse the widths of first surface 6 and second surface 8 at forty five degree angles such that, when viewed from above lumber sticker 5, channels 13 on first surface 6 are substantially perpendicular to channels 13 on second surface 8, forming a crisscross pattern.

Channels 13 are spaced such that a high and substantially flat plateau 12 with a definite width remains between each channel 13, allowing for stable support of the lumber to be stacked. The width of plateaus 12 depends on the strength of the material chosen to construct lumber sticker 5, the hardness of the lumber being separated and supported, and the desire to minimize or avoid sticker shadows. The more narrow the width of plateaus 12, the greater the surface area of the lumber exposed to ambient or kiln air, and the less likely there will be sticker shadows. However, the width of plateaus 12 must be wide enough to support the lumber. If the width of plateaus 12 is too narrow, the lumber may be bruised or otherwise damaged. Other channel configurations may also be used to allow for airflow between the individual units in the stack, such as longitudinal channels 13 generally parallel to the length of lumber sticker 5 or transverse channels 13 generally perpendicular to the length of lumber sticker 5. In the embodiment shown in FIG. 1, channels 13 are concavely cut in a generally arcuate manner.

Figure 2:
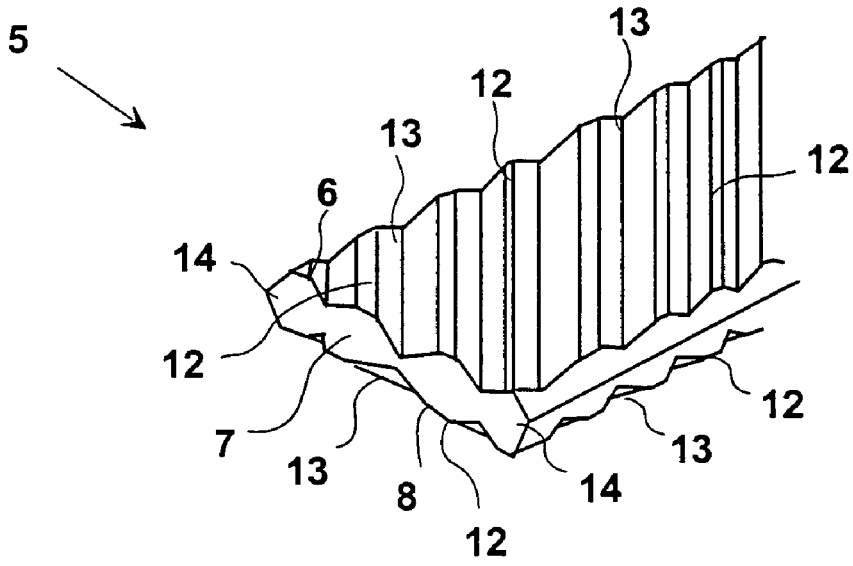
FIG. 2 shows a top view perspective drawing of another embodiment of the invention with V-shaped channels and pyramidal side surfaces.

FIG. 2 shows a top view perspective drawing of another embodiment of lumber sticker 5, but with two significant differences as compared to FIG. 1. First, channels 13 are constructed in a V-shape. Second, side surfaces 14 are pyramidally shaped rather than rounded. The exact shape of side surfaces 14 is not important; only that they be shaped such that lumber sticker 5 is self-righting to either first surface 6 or second surface 8. Plateaus 12, front surface 7, first surface 6, and second surface 8 can also all be appreciated in FIG. 2.

Figure 3:
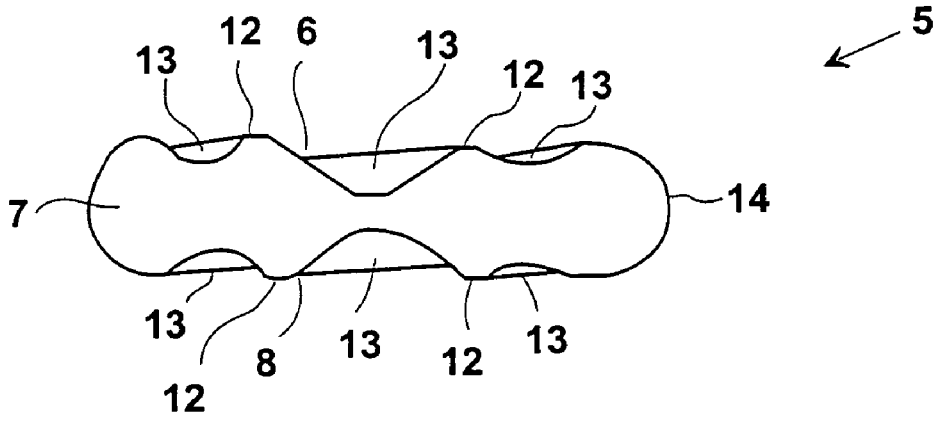
FIG. 3 shows a cross-sectional view of an embodiment of the invention depicting concave arcuate curves in channels diagonally traversing the width of the lumber sticker.

FIG. 3 shows a cross-sectional view of another embodiment of the invention depicting channels 13, with concavely curved or arcuate surfaces diagonally traversing the width of lumber sticker 5, and rounded side surfaces 14. In this view, it can be appreciated that channel 13 is more shallow as it approaches side surfaces 14 of lumber sticker 5 and is deepest at the midpoint of channel 13. The midpoint is defined as the point in channel 13 that is equidistant from each of side surfaces 14 of lumber sticker 5. This embodiment allows for increased air circulation regardless of the actual width of lumber sticker 5 and helps to minimize or eliminate stains on the lumber. It will be appreciated by one of ordinary skill in the art that other shapes of channels 13 can be used. For example, channels 13 can be cut in a series of flat surfaces creating a generally concave surface, a "V-shape" (as shown in FIG. 2) or any other configuration well-known to one of ordinary skill in the art that will permit air flow through channels 13.

FIG. 3 also shows rounded sides 14 of lumber sticker 5. Side surfaces 14 are shaped to allow lumber sticker 5 to fall with either first surface 6 or second surface 8 facing up when dropped while forming lumber stacks. Rather, if placed on the lumber stack with one of side surfaces 14 facing down, because of the shape of sides 14, lumber sticker 5 will fall so that either first surface 6 or second surface 8 will be facing up, i.e., prevent lumber sticker 5 from coming to rest on side surfaces 14. One of ordinary skill in the art will recognize a variety of shapes in which side surfaces 14 could be constructed to achieve the self-righting effect.

Side surfaces 14 of lumber sticker 5 also act as a safety feature in that they eliminate the unstable formation of stacks by enabling lumber sticker 5 to fall on either first surface 6 or second surface 8 and remain on those surfaces even if accidents occur such as the bumping of a forklift into the lumber stack. In the embodiment shown in FIG. 3, side surfaces 14 are substantially rounded. In alternate embodiments, sides 14 may be multi-faceted (e.g., pyramidal as in FIG. 2, or hexagonal), or any other shape that prevents lumber sticker 5 from remaining stationary on side surfaces 14 or supporting lumber directly on side surfaces 14.

What is claimed is:

1. A device for use in stacking lumber comprised of:

a substantially planar top surface;

a substantially planar bottom surface, said bottom surface being substantially parallel to said top surface;

two side surfaces, each of said two side surfaces being outwardly arcuately shaped such that said device cannot rest on either of said two side surfaces;

a back surface and a front surface, said back surface and said front surface being substantially parallel to each other, said back surface and said front surface each having a height and a width, said height being less than said width;

a plurality of channels on each of said top surface and said bottom surface; and a plurality of plateaus on each of said top surface and said bottom surface, wherein each of said plurality of plateaus separates each of said plurality of channels.

2. The device of claim 1, wherein each of said plurality of channels traverses either said top surface or said bottom surface from a first edge to a second edge.

3. The device of claim 1, wherein each of said plurality of channels on said top surface are parallel to one another, and each of said plurality of channels on said bottom surface are parallel to one another.

4. The device of claim 3, wherein said plurality of channels traverse said top surface and said bottom surface at a diagonal, relative to a length of said device.

5. The device of claim 4, wherein said diagonal is approximately forty five degrees.

6. The device of claim 5, wherein each of said plurality of channels on said top surface are substantially perpendicular to each of said plurality of channels on said bottom surface.

7. A self-righting device used in stacking lumber comprised of:

a substantially planar top surface;

a substantially planar bottom surface, said bottom surface being substantially parallel to said top surface;

two side surfaces, said side surfaces being multi-faceted to prevent said device from resting on either of said two side surfaces;

a back surface and a front surface, said back surface and said front surface being substantially parallel to each other, said back surface and said front surface each having a width and a height, said width being greater than said height;

a plurality of channels on each of said top surface and said bottom surface; and a plurality of plateaus on each of said top surface and said bottom surface, wherein each of said plurality of plateaus separates each of said plurality of channels.

8. The device of claim 1, wherein each of said plurality of channels is V-shaped.

9. The device of claim 1, wherein each of said plurality of channels has a midpoint, and wherein each of said plurality of channels is deepest at said midpoint.

10. The device of claim 1, wherein said device is made of a material selected from a group comprised of a plastic, a metal, a wood, a fiberglass, a resin compound, and a composite.

11. The device of claim 7, wherein each of said plurality of channels traverses either said top surface or said bottom surface from a first edge to a second edge.

12. The device of claim 7, wherein each of said plurality of channels on said top surface are parallel to one another, and each of said plurality of channels on said bottom surface are parallel to one another.

13. The device of claim 12, wherein said plurality of channels traverse said top surface and said bottom surface at a diagonal, relative to a length of said device.

14. The device of claim 13, wherein said diagonal is approximately forty five degrees.

15. The device of claim 14, wherein each of said plurality of channels on said top surface are substantially perpendicular to each of said plurality of channels on said bottom surface.

16. The device of claim 7, wherein each of said plurality of channels is V-shaped.

17. The device of claim 7, wherein each of said plurality of channels has a midpoint, and wherein each of said plurality of channels is deepest at said midpoint.

18. The device of claim 7, wherein said device is made of a material selected from a group comprised of a plastic, a metal, a wood, a fiberglass, a resin compound, and a composite.

19. A self-righting lumber sticker for separating lumber having:

a length, a height, and a width;

said length and said width being defined by a substantially planar top surface and a substantially planar bottom surface;

said height and said width being defined by a front surface and a back surface, and wherein said height is less than said width;

said length and said height being defined by two side surfaces, said two side surfaces being convexly arcuately shaped such that said self-righting lumber sticker cannot rest on either of said two side surfaces;

a first plurality of channels formed on said top surface and extending transverse to said substantially planar top surface from a first edge to a second edge of said lumber sticker;

a second plurality of channels formed on said bottom surface and extending transverse to said substantially planar bottom surface from a third edge to a fourth edge of said lumber sticker; and a plurality of plateaus, one of said plurality of plateaus separating each of said first plurality of channels or each of said second plurality of channels.

20. The lumber sticker of claim 19, wherein each of said first plurality of channels and each of said second plurality of channels are V-shaped.

21. The lumber sticker of claim 19, wherein each of said first plurality of channels has a first midpoint and each of said second plurality of channels has a second midpoint, and wherein each of said plurality of first channels and each of said plurality of second channels is deepest at said first midpoint and said second midpoint, respectively.

22. The device of claim 19, wherein each of said first plurality of channels are parallel to one another, and wherein each of said second plurality of channels are parallel to one another.

23. The lumber sticker of claim 22, wherein each of said first plurality of channels traverse said substantially planar top surface at a first diagonal and said second plurality of channels traverse said substantially planar bottom surface at a second diagonal.

24. The lumber sticker of claim 23, wherein said first diagonal and said second diagonal are each approximately forty five degrees relative to said length.

25. The lumber sticker of claim 24, wherein said first plurality of channels on said top surface are substantially perpendicular to each of said second plurality of channels on said bottom surface.

26. The lumber sticker of claim 19, wherein said lumber sticker is made of a material selected from a group comprised of a plastic, a metal, a wood, a fiberglass, a resin compound, and a composite.

* * * * *